United States Patent [19]

Sasaki

[11] Patent Number: 5,040,089

[45] Date of Patent: Aug. 13, 1991

[54] D.C. RELAY WITH POWER REDUCING FUNCTION

[75] Inventor: Akimasa Sasaki, Nagoya, Japan

[73] Assignee: Kabushiki Kaisha Toshiba, Kawasaki, Japan

[21] Appl. No.: 100,279

[22] Filed: Sep. 23, 1987

[30] Foreign Application Priority Data

Nov. 26, 1986 [JP] Japan ..... 61-279712
May 11, 1987 [JP] Japan ..... 62-114001

[51] Int. Cl.[5] ..... H01H 47/00

[52] U.S. Cl. ..... 361/160; 219/10.55 B; 361/187

[58] Field of Search ..... 219/10.55 B, 10.55 E; 361/139, 143, 152, 160, 170, 187

[56] References Cited

U.S. PATENT DOCUMENTS

| | | | |
|---|---|---|---|
| 4,039,903 | 8/1977 | Russell | 361/187 |
| 4,160,283 | 7/1979 | Adams | 361/143 |
| 4,295,111 | 10/1981 | Wang | 335/256 |
| 4,609,965 | 9/1986 | Baker | 335/256 |
| 4,754,362 | 6/1988 | Beller | 361/187 |
| 4,803,589 | 2/1989 | Kimpel | 335/256 |

FOREIGN PATENT DOCUMENTS

| | | |
|---|---|---|
| 0221801 | 5/1987 | European Pat. Off. . |
| 61-25157 | 7/1986 | Japan . |
| 61-291528 | 8/1986 | Japan . |
| 0272012 | 6/1927 | United Kingdom . |
| 525510 | 8/1940 | United Kingdom . |
| 0553998 | 6/1943 | United Kingdom . |
| 0817035 | 7/1959 | United Kingdom . |
| 2109164 | 5/1983 | United Kingdom . |

*Primary Examiner*—A. D. Pellinen
*Assistant Examiner*—Jeffrey A. Gaffin
*Attorney, Agent, or Firm*—Cushman, Darby & Cushman

[57] ABSTRACT

A relay including an internal power reducing mechanism for automatically reducing the relay's power consumption without the need for any periphral power reducing circuits. The relay includes a pair of relay contacts for alternately opening and closing an elctromagnetic coil for generating a magnetic force, a switch member and at least one coil terminal for controlling the resistance of, and thus the current level in, the electromagnetic coil, after the relay is energized. To reduce the power consumption of the relay, in response to the magnetic force of the electromagnetic coil, the movable contact plate simultaneously moves one of the relay contacts with respect to the other and the switch member with respect to the coil terminal. By this movement of the movable contact plate, the pair of relay contacts are closed and an additional electromagnetic coil or a resistor is connected in series with the electromagnetic coil, thus increasing the effective electrical resistance of the electromagnetic coil. As the result, a holding current level is less than a driving current level needed to initialize an energized state.

13 Claims, 4 Drawing Sheets

D.C. RELAY WITH POWER REDUCING FUNCTION

BACKGROUND OF THE INVENTION

1. Field of the invention

The present invention relates, in general, to relays. More particularly, the invention relates to a D.C. relay with a power reducing function, which is used in the control circuit of a cooking apparatus, such as a microwave oven.

2. Description of the prior art

Generally, as is illustrated in FIG. 1, a typical D.C. relay includes of an L-shaped base, an iron core mounted on the base, an exciting coil wound around the iron core, a movable contact plate supported at an upper part of the base and over the iron core, a movable contact attached to the movable contact plate and electrically connected with the a fixed terminal of the circuit, a fixed contact facing the movable contact, connected with another fixed terminal of the circuit, and a spring for biasing the movable contact plate to open the contacts of the relay.

In this well-known D.C. relay, when a D.C voltage is applied to the exciting coil, the iron core is magnetized and a force of attraction between the movable contact plate and the iron core is provided. By this force of attraction. the contacts of the relay are closed. Consequently, the fixed terminals of the circuit also are closed. When the D.C. voltage applied to the exciting coil is shut off, the force of attraction between the iron core and the movable contact plate dissipates, and the contacts of the relay are biasing force of the spring. Consequently, the fixed terminals of the circuit are opened.

As is also well known, cooking apparatus, such as, e.g, microwave ovens, have D.C. relays as mentioned above in their control circuits for operating appropriate devices such as fans, heaters, magnetrons and so on.

At the present time, a cooking apparatus is required to have many functions. For example, a microwave oven typically has not only the capability of warming food with microwaves from a magnetron, but also the capability of roasting food with an electric heater.

The greater the number of functions of cooking apparatus is, the greater the number of D.C. relays which must be used in the control circuit thereof. The greater the number of D.C. relays used in the control circuit, the more electric power is consumed in the control circuit. This is because the power consumption of a D.C. relay generally is constant at all times.

Therefore, to supply more power to the control circuit when more functions of cooking apparatus are present, the power supplying transformer Of the control circuit must be larger. This results in a larger and more expensive apparatus.

In order to solve the problem mentioned above, a relay control circuit has been developed which reduces the power consumption of a D.C. relay by decreasing the D.C. power required for holding the relay in a closed state.

The examples of such relay control circuits are disclosed in Japanese Utility Model Publication No. 29152, filed in Feb. 18, 1977 in the name of Masaaki Ishikawa, etc., and in Japanese Utility Model Publication No. 25157, filed in Nov. 24, 1976 in the name of Shigeki Kitamura, etc, respectively.

In Japanese Utility Model Publication No. 29152, a positive pulsating voltage is generated by algebraically adding a half-wave rectified A.C. voltage to a D.C. voltage. And the D.C relay is driven by feeding this positive pulsating voltage at a positive potential with respect to the D.C. voltage, and the D.C relay is maintained in the closed state by the D.C. voltage.

In Japanese Utility Model Publication No. 25157, the D.C relay is closed by an activating D.C. current higher than a holding D.C. current, and is maintained in the closed state by the holding D.C. current.

In this prior art, because each D.C. relay has no internal means to reduce power consumption, a supplemental relay control circuit is necessary to reduce the power consumption of the D.C relay. Therefore, when the number of D.C relays used in the control circuit increases in proportion to the function of a cooking apparatus, such as a microwave oven, there is no need for the power supplying transformer itself to be made larger, however, because each of the D.C relays requires a supplemental relay control circuit in order to reduce the power consumption, the control circuit substrate in which power supplying transformer and other electronic parts forming the control circuit are mounted must be made larger (in proportion to the function of cooking apparatus).

As a result, in this prior art, the control circuit of a cooking appratus such as a microwave oven becomes larger and more expensive as the number of the functions increases.

SUMMARY OF THE INVENTION

It is an object of the present invention to reduce the power consumption of a relay without the need for extra relay control circuits.

It is another object of the present invention to make a cooking apparatus, such as, e.g., a microwave oven, have many functions without increasing the size or cost substantially.

To accomplish the objects described above, the present invention provides a relay including a pair of relay contacts for alternately opening and closing with respect to each other, electromagnetic coil unit for generating a magnetic force, power reducing unit, and movable contact plate unit, the power reducing unit including a switch member and at least on coil terminal for controlling the current level in the electromagnetic coil unit, and the movable contact plate unit simultaneously moving one of the relay contacts with respect to the other and the switch member with respect to the coil terminal in response to the magnetic force of the electromagnetic coil unit.

BRIEF DESCRIPTION OF THE DRAWINGS

The present invention is best understood with reference to accompanying drawings in which.

DETAILED DESCRIPTION OF THE PREFERRED EMBODIMENTS

Referring to the accompanying drawings, an embodiment of the present invention will be described.

Figure 2:
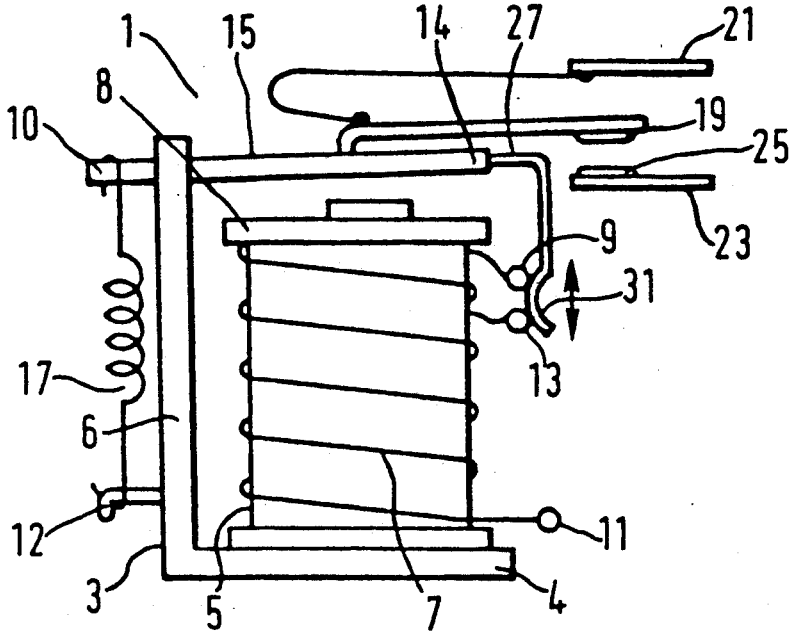
FIG. 2 is an elevational view illustrating a D.C relay of one embodiment of the present invention.

FIG. 2 is an elevational view illustrating a D.C relay of one embodiment of the present invention. A D.C relay 1 has an L-shaped base 3. An iron core 5 is disposed on a bottom part 4 of the base 3.

Around the iron core an exciting coil 7 is wound, and the exciting coil 7 has a first terminal 9 at one end, a second terminal 11 at the other end, and a third terminal 13 between the first and the second terminals. The exciting coil 7 includes a first exciting coil *7a* and a second exciting coil *7b*. The first exciting coil *7a* and the second exciting coil *7b* are connected in series at the third terminal 13.

A movable contact plate 15 is supported in a vertical portion 6 of said base 3 facing an upper end 8 of the iron core 5. This movable contact plate 15 is made of iron, and is installed in the vertical portion 6 of the base 3 for pivoting freely upward or downward. When the exciting coil 7 is deenergized, the the contact plate 15 is pulled upward as contacts of a D.C relay are opened by a spring 17 stretched between one end of the movable contact plate 15 and a projection on the base 3.

A movable contact 19 is installed on the movable contact plate 15 and is electrically connected with one of the fixed terminals of 21, 23 of the control circuit. Facing the movable contact 19, is a fixed contact 25 connected with the other of the fixed terminals 21, 23 of the control circuit.

A switching plate 27 is disposed at the other end 14 of the movable contact plate 15, and when the exciting coil 7 is deenergized, the switching plate 27 connects the first terminal 9 of the exciting coil 7 with the third terminal 13 of the exciting coil 7. When the exciting coil 7 is energized, the switching plate 27 opens those terminals 9, 13 of the exciting coil 7. If the D.C relay is of the bi-directional type, one more fixed contact may be disposed over said movable contact 19.

Figure 3:
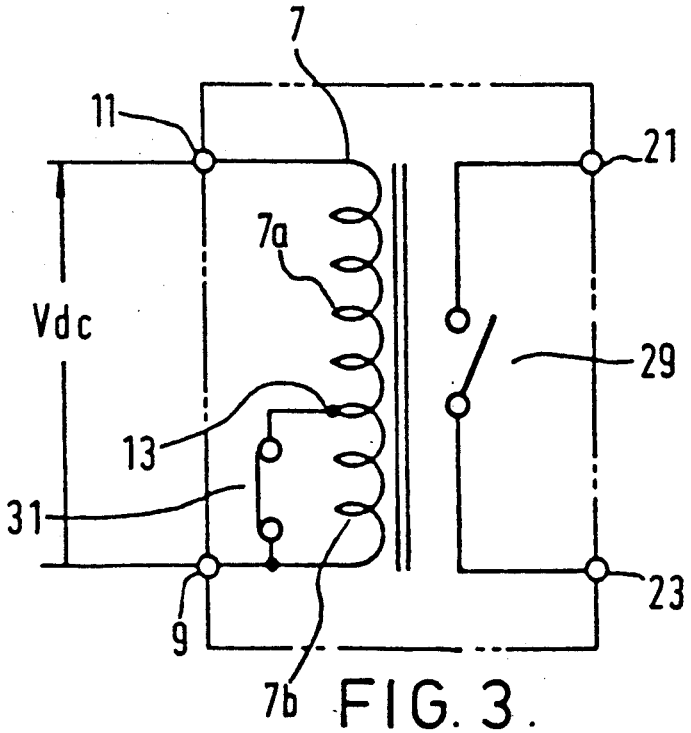
FIG. 3 is a schematic diagram of a circuit included in the D.C relay, as shown in FIG. 2.

Referring to the FIG. 2 and FIG. 3, when D.C voltage Vdc is applied across the first and the second terminals, direct-current is applied to the exciting coil 7 and the iron core 5 is magnetized.

In this condition, because the switching plate 27 connects the first terminal 9 with the third terminal 13, the direct-current starts to flow only through the first exciting coil *7a*, and the electrical resistance of the exciting coil 7 becomes equal to the electrical resistance of the first exciting coil *7a*. Therefore, the direct-current applied to the exciting coil 7 increases, and an attractive force strong enough to move the movable contact plate 15 is generated on the iron core 6.

When the iron core 5 is magnetized, the movable contact plate 15 is attracted to the iron core 5, and the movable contact 19 makes contact with the fixed contact 25.

As a result, the normally open contact 29 between the both fixed terminals 21, 23 of the control circuit are closed. Once the movable contact plate 15 has been attracted to the iron core 5, the normally closed contact 31 is opened, because the switching plate 27 is separated from the third terminal 13.

As may be easily understood from FIG. 3, when the normally closed contacts 31 are opened, direct current flows through both the first and the second exciting coils *7a*, *7b* and the electrical resistance of the exciting coil 7 becomes equal to the sum Of the electrical resistance of the first and the second exciting coils.

Therefore, the direct-current applied to the exciting coil 7 is reduced to a less level than the direct-current flowing only through the first exciting coil when the normally closed contact 31 is closed. This reduced direct-current is sufficient to keep the D.C relay latched on, because the necessary force to keep the D.C relay in the on state is less than the force needed to drive the D.C relay.

When D.C voltage Vdc is removed, the iron core 5 is demagnetized, and the movable contact plate 15 is separated from the iron core 5 by the force of spring 17. Thus, the movable contact 19 is disconnected from the fixed contact 25, and the normally open contact 29 between the fixed terminals 21, 23 of the control circuit is opened.

As can be understood from the above-described embodiment, in this D.C relay having an integral power reducing mechanism, the direct current flowing in the exciting coil when the D.C relay is kept latched on need produce only a relatively weak magnetomotive force. This force is less than the force needed to drive the D.C. relay. Thus, the power consumption of the D.C relay can be reduced.

Figure 4:
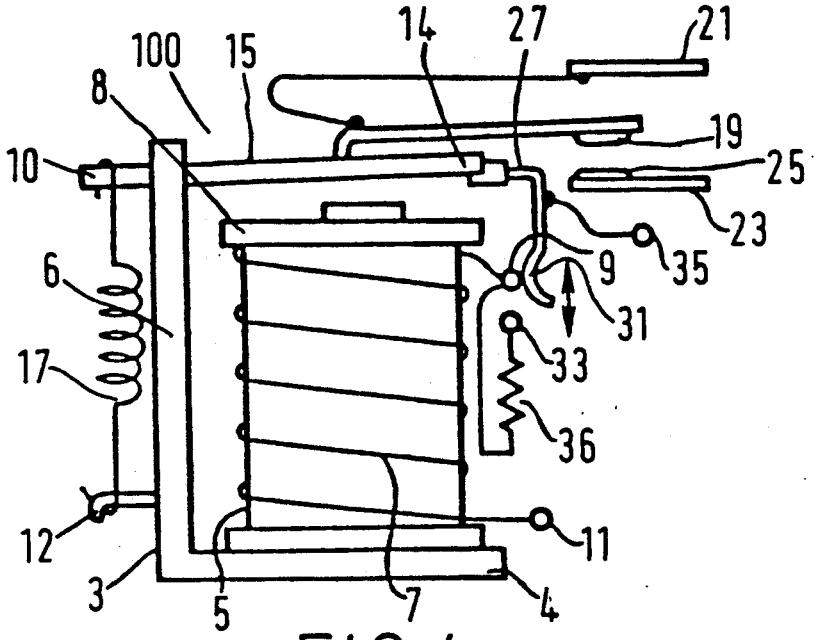
FIG. 4 is an elevational view illustrating a D.C relay of another embodiment of the present invention.
Figure 5:
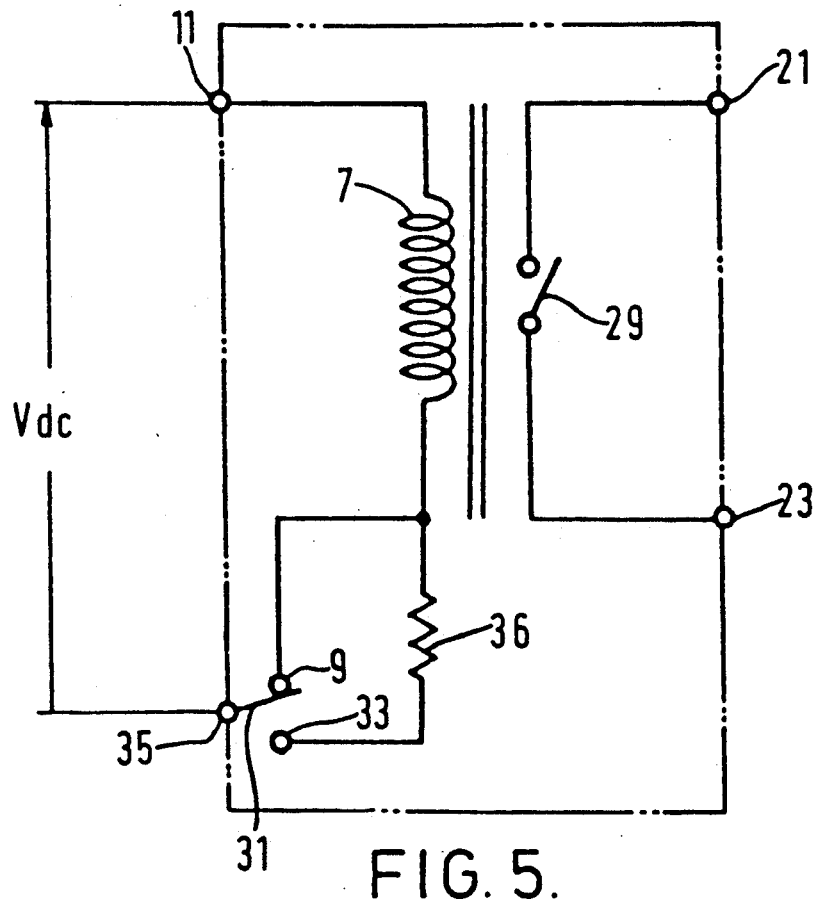
FIG. 5 is a schematic diagram of a circuit included in the D.C relay, as shown in FIG. 4.

Referring to FIG. 4 and FIG. 5, another embodiment of this present invention will be described.

In this embodiment of the present invention, a D.C relay 100 has almost the same construction as the D.C relay 1 of the first embodiment of this present invention.

This D.C relay 100 has a switching terminal 33, a source terminal 35 and a resistor 36. The resistor 36 is connected between the first terminal 9 of the exciting coil 7 and the switching terminal 33. The source terminal 35 is connected with the switching plate 27. D.C voltage is applied across the source terminal 35 and the second terminal 11 of the exciting coil 7.

Figure 1:
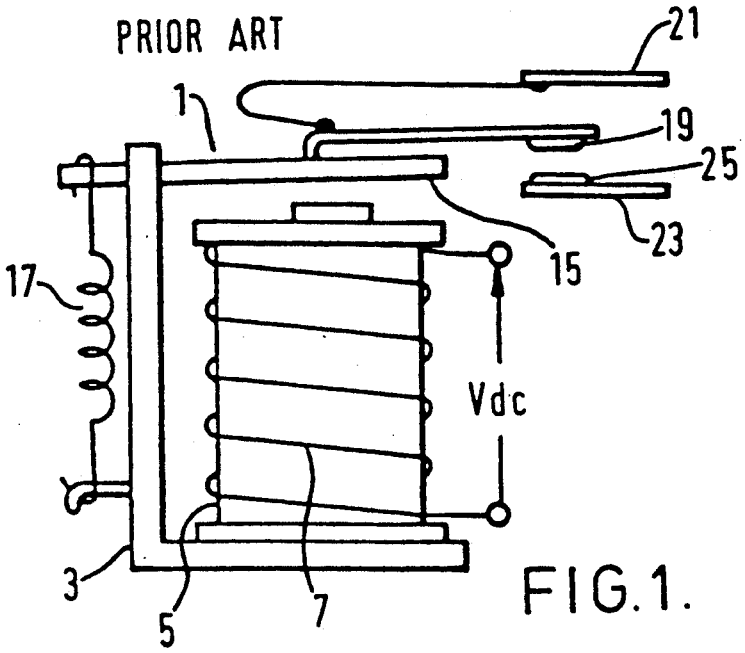
FIG. 1 is an elevational view illustrating a D.C relay of the prior art.
Figure 6:
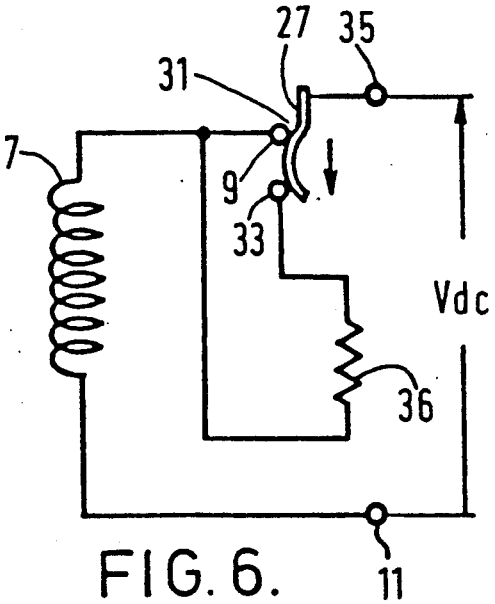
FIG. 6 shows a schematic diagram of a circuit of the relay of FIG. 5 in an operating condition.
Figure 7:
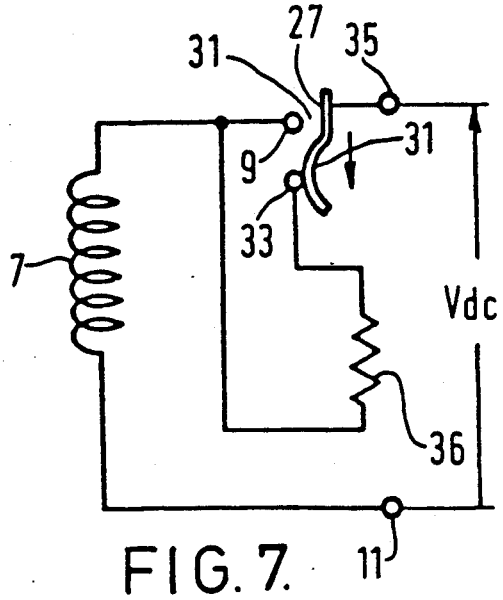
FIG. 7 shows a schematic diagram of a circuit of the relay of FIG. 5 in another operating condition.

As is shown in FIGS. 5–7, when the D.C relay 100 starts to be driven direct current flows only through the exciting coil 7 because the switching plate 27 is kept in contact with both the first terminal 9 of the exciting coil 7 and the switching terminal 33, as is shown in FIG. 6. The iron core 5 becomes magnetized, and once the movable contact plate 15 has been attracted to the iron core 5, the switching plate 27 contacts only the switching terminal 33. As the result, direct current flows through the circuit employing a resistor 36 and the exciting coil 7 in series, as is shown in FIG. 7. Because the composite resistance of resistor 36 and exciting coil 7 is larger than the resistance of the exciting coil 7, itself, the direct current flowing through the exciting coil 7, and the resistor while the D.C relay is maintained in the on state is limited automatically to a lower level than the direct current flowing through only the exciting coil during the time the D.C relay is driven. Therefore, the power consumption of the D.C relay also can be reduced automatically reduced in this embodiment.

Figure 8:
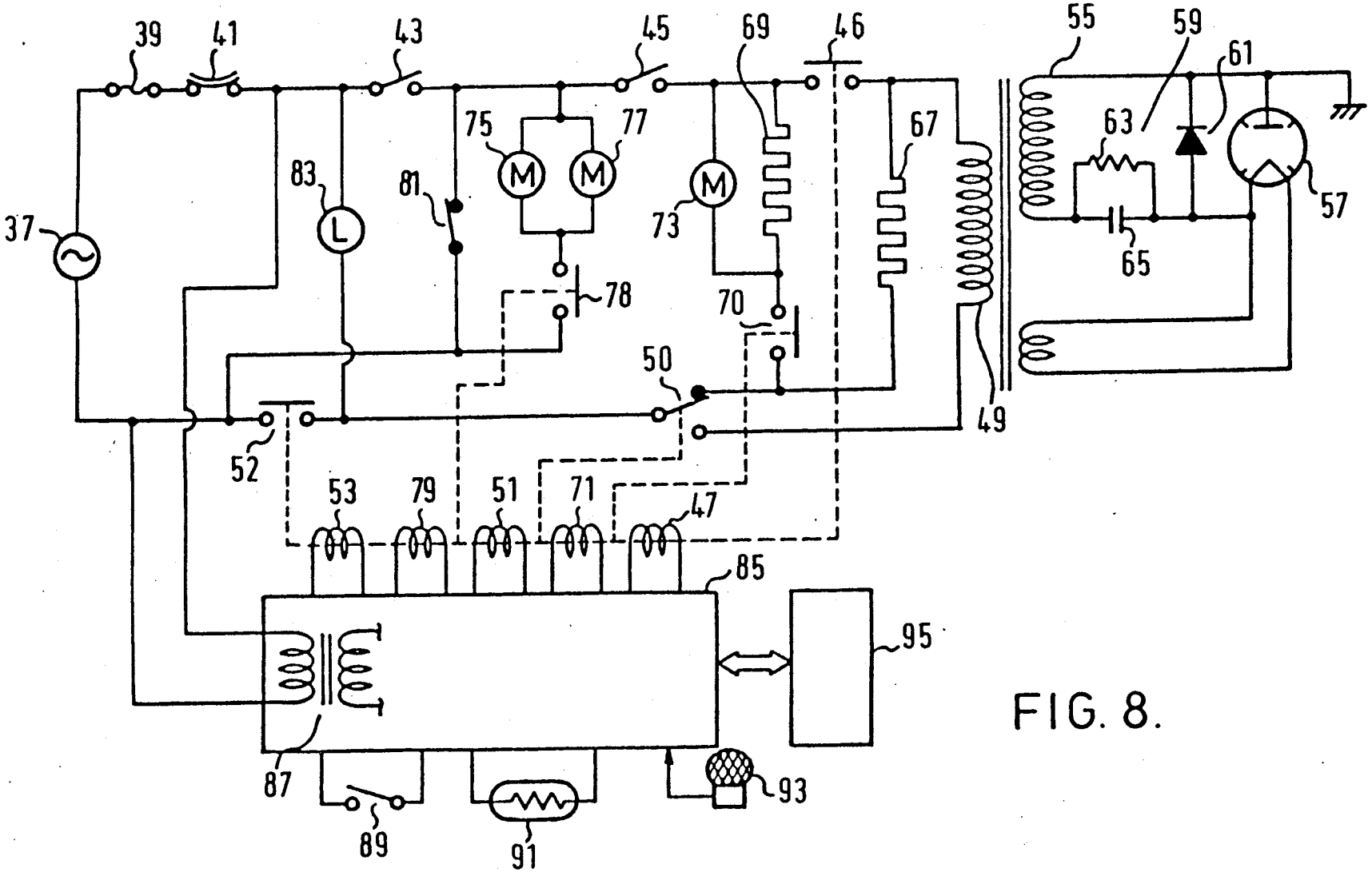
FIG. 8 is a schematic diagram of a circuit used in a microwave oven with the D.C relays of FIG. 2 or FIG. 4.

FIG. 8 shows the control circuit of a microwave oven in which D.C relays of this invention are used.

With a 100 volt A.C. supply 37. the primary coil of the high voltage transformer 49 is connected in series through a circuit employing a fuse 39, a magnetron thermal switch 41, a first door switch 43, a second door switch 45, a contact 46 of the first D.C relay 47, a bi-directional contact 50 of the second D.C relay 51, and a contact 52 of the third D.C relay 53.

With the secondary coil of the high voltage transformer 55, a magnetron 57 is connected at its cathode and anode in series through the double voltage rectifier circuit 59 employing in series a high voltage diode 61 and parallel circuit comprising a discharging resistor 63 and a high voltage capacitor 65.

A grille heater 67 is connected in series with the 100 volt A.C. supply 37 through a circuit employing a fuse 39, a magnetron thermal switch 41, the first door switch 43, the second door switch 45, a contact 46 of the first D.C relay 47, a bi-directional contact 50 of the second D.C relay 51, and a contact 52 of the third D.C relay 53.

A hot air generating heater 69 is connected in series with the 100 volt A.C. supply 37 through the circuit employing a fuse 39, a magnetron thermal switch 41, the first door switch 43, the second door switch 45, a contact 70 of the fourth D.C relay 71, a bi-directional contact 50 of the second D.C relay 51, and a contact 52 of the third D.C relay 53 in series, and in parallel with the hot air generating heater 69, a hot air circulating fan motor 73 is connected.

A parallel circuit comprising a turn-table driving motor 75 and a magnetron cooling fan motor 77 is connected in series with the 100 volt A.C. supply 37 through the circuit employing a fuse 39, a magnetron thermal switch 41, the first door switch 43 and a contact 78 of the fifth D.C relay 79.

A door monitor switch 81 is connected in series with the 100 volt A.C. supply 37 through the circuit employing a fuse 39, a magnetron thermal switch 41, and the first door switch 43.

A chamber lamp 33 by which the heating chamber is lighted, is connected with the 100 volt A.C. supply 37 through the circuit employing a fuse 39 a magnetron thermal switch 41, and a contact 52 of the third D.C relay 53.

A control device 85, including a microcomputer and associated interface circuits, controls all the operations of the microwave oven.

The control device 85 has a power supply transformer 87 through which electric power for driving is supplied.

The primary coil of the power supply transformer 87 is connected with the 100 volt A.C. supply 37 through a circuit employing a fuse 39 and a magnetron thermal switch 41 in series. Moreover, a door open monitor switch 89, a thermal sensor 91 detecting temperature in the heating chamber, a gas sensor 93 detecting the amount of Carbon Dioxide from the food heated in the chamber, display means 94, such as an LED for displaying operating information, and the five D.C relays 47, 51, 53, 71, 79 are connected with the control device 85.

The microwave oven employing the control circuit as shown in FIG. 8 has three primary functions. These functions include operation as a standard microwave oven, a grill, and a hot air oven.

When this microwave oven is used as an standard microwave oven, the first door switch 43, the second door switch 45, the contact 46 of the first D.C relay 47, the bi-directional contact 50 of the second D.C relay 51, the contact 52 of the third D.C relay 53, and the contact 78 of the fifth D.C relay 79 are all closed and the door monitor switch 81 is opened.

In the case of automatic microwave cooking, the operation may be controlled by the gas sensor 93.

When this microwave oven is used as a grill, the first door switch 43, the second door switch 45, the contact 46 of the first D.C. relay 47, and the contact 52 of the third D.C relay 53 are all closed, and the door monitor switch 81, the contact 70 of the forth D.C relay 71, and the contact 78 of the fifth D.C relay 79 are all opened.

When this microwave oven is used as a hot air oven, the first door switch 43, the second door switch 45, the contact 70 of the forth D.C relay 71, and the contact 52 of the third D.C relay 53 are all closed, and the contact 46 of the first D.C relay 47, the contact 78 of the fifth D.C relay 79, and the door monitor switch 81 are all opened.

The operation may be cotrolled automatically by the thermal sensor 91.

The door open monitor switch 89 informs the microcomputer of the control device that the door is opened.

As can be understood from the above-described embodiments, each of the five D.C relays, having a internal power reducing mechanism, can reduce its power consumption without any extra relay control circuit. Therefore, with this D.C relay, both the power supply transformer of the control device of a cooking apparatus, and the control device itself can be made smaller. As the result, a cooking apparatus, itself, also can be made smaller and cheaper.

The present invention has been described with respect to specific embodiments. However, other embodiments based on the principles of the present invention should be obvious to those of ordinary skill in the art. Such embodiments are intended to be covered by the claims.

What is claimed is:

1. A relay, comprising:

a movable contact plate;

a pair of relay contacts for alternately opening and closing with respect to each other;

electromagnetic coil means for generating a magnetic force;

power reducing means including a switch member and at least one coil terminal for varying, the electrical resistance of, and thus the current level in the electromagnetic coil means;

said movable contact plate being responsive to the magnetic force of said electromagnetic coil means for simultaneously moving one of said relay contacts, with respect to the other, and said switch member, with respect to said coil terminal so as to effectively increase the resistance of said electromagnetic coil means when said movable contact plate has been displaced from an initial position due to said electromagnetic force.

2. A relay according to claim 1, wherein said electromagnetic coil means includes an iron core and said movable contact plate includes a frame for supporting the iron core and a contact plate pivotally attached to the frame for movement with respect to electromagnetic coil means.

3. A relay according to claim 2, wherein the movable contact plate means also includes biasing means for biasing the contact plate away from the electromagnetic coil means.

4. A relay according to claim 3, wherein the biasing means includes a spring.

5. A relay according to claim 4, wherein the frame includes an L-shaped member having a projection thereon, the contact plate includes an overhanging end portion, and the spring is disposed between the projection and the overhanging end portion.

6. A relay according to claim 2, wherein the electromagnetic coil means includes a first and a second coils connected in series and surrounding the iron core.

7. A relay according to claim 6, wherein the power reducing means includes two coil terminals, one coil terminal being connected with each of the first and the second coils, respectively, 8. A relay according to claim 2, wherein the electromagnetic oil means includes an exciting coil and a resistor connected in series, the exciting coil surrounding the iron core.

9. A relay according to claim 8, wherein the power reducing means includes two coil terminals, one coil terminal being connected in series with the resistor and the other coil terminal being connected with the connection point of the exciting coil and the resistor.

10. A relay according to claim 2, wherein one of the relay contacts is fixed, and the other is mounted to the contact plate for movement together with the contact plate.

11. A relay according to claim 10, wherein the switch member includes a conductive strip attached to the contact plate for movement therewith.

12. A method for reducing power consumption in an electric relay, the relay including a pair of relay contacts for alternately opening and closing with respect to each other, and a variable resistance coil comprising the steps of:

placing an electrical potential across said coil so as to move one of said relay contacts between a first and a second position with respect to each other responsive to an electromagnetic force generated by said coil; and simultaneously increasing a resistance of said coil, thus lowering a current there through, while maintaining sufficient electromagnetic force to keep said contacts in said second position.

13. A method for reducing power consumption in an electrical relay, the relay including a pair of relay contacts for alternately opening and closing the relay, and a coil comprising the steps of:

placing an electrical potential across said coil so as to move one of said relay contacts between a first and second position with respect to the other response to an electromagnetic force generated by said coil; and simultaneously adding a resistance in series with said coil so as to reduce current through said coil while maintaining sufficient electromagnetic force to keep said relay contacts in said second position.

* * * * *